United States Patent [19]

Soberg

[11] 3,941,516

[45] Mar. 2, 1976

[54] WATERWELL PUMP ASSEMBLY

[76] Inventor: Arnold S. Soberg, 1323 Degener Ave., Elmhurst, Ill. 60126

[22] Filed: Sept. 4, 1974

[21] Appl. No.: 502,928

[52] U.S. Cl. ..... 417/259; 417/552

[51] Int. Cl.[2] ..... F04B 3/00

[58] Field of Search ..... 417/259, 260, 552

[56] References Cited

UNITED STATES PATENTS

| | | | |
|---|---|---|---|
| 765,541 | 7/1904 | Beers | 417/552 |
| 968,029 | 8/1910 | Cross | 417/552 |
| 1,043,279 | 11/1912 | Wheeler | 417/552 |
| 1,542,248 | 6/1925 | Howe | 417/259 |
| 1,696,007 | 12/1928 | Lewis et al. | 417/259 |
| 1,793,572 | 2/1931 | vonLinde | 417/259 |
| 2,723,625 | 11/1955 | Nichols | 417/259 |
| 3,074,352 | 1/1963 | Vincent | 417/259 |

*Primary Examiner*—William L. Freeh
*Attorney, Agent, or Firm*—Edward R. Lowndes

[57] ABSTRACT

A water well pump assembly designed for operation within a well casing and embodying a pump cylinder having the usual foot valve and traveling plunger valve, together with a novel head valve which is disposed at the upper end of the cylinder above the plunger valve and which functions when an excess quantity of air enters the cylinder through the foot valve to prevent the hydrostatic column of liquid in the liquid outlet pipe above the plunger from following the latter during its downstroke. By such an arrangement, the resultant partial vacuum which is established by downward movement of the plunger causes the foot valve to become seated and the traveling valve to become unseated so that upward movement of the plunger causes unseating of the head valve and passage of the excess air upwardly into the liquid outlet pipe. Continued reciprocation of the plunger causes the pump assembly to function in the manner of a gas pump until such time as the excess air is discharged from the cylinder, after which the pump assembly resumes its function as a water pump.

2 Claims, 3 Drawing Figures

WATERWELL PUMP ASSEMBLY

The improved pump assembly comprising the present invention has been designed for use primarily in connection with water well pumping operations. The invention is however capable of other uses and pump assemblies embodying the principles of the invention may, if desired, with or without modification as required, be employed in connection with oil well or other pumping operations involving the pumping of a liquid from a well casing. Irrespective however of the particular use to which the invention may be put, the essential features thereof are at all times preserved.

Heretofore, in connection with conventional water well pumping operations, it has long been the practice to provide a pump assembly in the form of a cylinder having a foot valve at its lower end and within which there is provided a plunger which reciprocates within the cylinder and which has associated therewith the usual traveling valve. The cylinder is lowered within a well casing to the desired depth and the plunger with its associated traveling valve is connected by means of the usual pump shaft and cable to a suitable ground supported well driller's rig. Upon reciprocation of the plunger, as the latter moves downwardly within the cylinder, the hydrostatic head or column of liquid above the plunger follows the plunger so that the combined weight of such liquid column, plunger and pump shaft exerts a compressional force on the liquid beneath the plunger, thus causing the foot valve to become seated while the traveling valve becomes unseated so that the entrapped liquid above the foot valve passes through the traveling valve and is admitted to the space above the plunger. During the return or upward stroke of the plunger, this liquid above the plunger is forced upwardly in the well casing, or through a water outlet or drop pipe which may be employed within the casing so that it eventually is discharged from the casing at ground level.

Pump assemblies of this general character are possessed of certain limitations, principal among which is the fact that they do not operate satisfactorily when an undue amount of air or other gaseous media enters the pump cylinder through the foot valve. In the absence of excess gas, such pump assemblies ordinarily function satisfactorily to raise measured quantities of liquid successively to ground level but when an excessive amount of gas enter the cylinder, the weight of the liquid column above the plunger, which invariably follows the plunger during its downward motion, compresses the gas within the cylinder thus causing the foot valve to become seated. If the gas within the cylinder is thus compressed to such an extent that the upward stroke of the plunger does not relieve the pressure of the gas within the cylinder to a degree which will allow the foot valve to become unseated when the plunger reaches the top of its stroke, no fresh gas or liquid will enter the cylinder and further reciprocation of the plunger will be without effect, the plunger merely bouncing up and down on the entrapped pocket of gas within the cylinder so that no pumping action will be attained.

The present invention is designed to overcome the above-noted limitation that is attendant upon the construction and use of conventional water well and other pump assemblies and, toward this end, the invention contemplates the provision of a pump assembly which has associated therewith the usual foot valve and traveling plunger valve, together with a novel means for arresting the hydrostatic head or column of liquid which is disposed within the well casing above the level of the plunger so that it does not follow the plunger during downward movement of the latter, but instead remains elevated so that its weight has no effect upon the pressure of gas within the cylinder immediately above the foot valve. By such an arrangement, compression of the gas within the cylinder is a function solely of the weight of the plunger and its associated pump shaft. Thus, the reduction of pressure within the cylinder, as compared to conventional well pumps, is such that during upward movement of the plunger, expansion of the compressed gases is adequate to allow the foot valve to become unseated and thus admit fresh gas or liquid into the cylinder.

Briefly, in carrying out the invention, it is contemplated that, in addition to the usual foot valve and traveling piston valve, a third valve assembly which will hereinafter be referred to as the head valve, is provided at the upper end of the cylinder and consequently above the level of the plunger and its associated traveling valve. This head valve remains normally closed or seated so that it seals off the upper end of the cylinder, supports the hydrostatic head or column of liquid in the upper region of the well casing, and prevents such liquid column from entering the cylinder during downward movement of the plunger. As a consequence, such downward movement of the plunger creates a partial vacuum above the latter and below the head valve, thereby unseating the traveling valve which is associated with the plunger and drawing gas through the traveling valve so that upon the succeeding upward movement of the plunger the valve will become seated and the plunger will force gas upwardly through the head valve and into the upper region of the well casing for ultimate discharge at ground level, while at the same time creating a vacuum deep within the well casing below the level of the pump assembly. By such an arrangement, the present pump assembly functions as a liquid pump when no appreciable amount of gas is present in the cylinder, and functions as a gas pump when an excessive amount of gas enters such cylinder, the transition from liquid to gas and vice versa taking place automatically and requiring no attention on the part of an operator.

The provision of a pump assembly such as has briefly been outlined above, and possessing the stated advantages, constitutes the principal object of the present invention.

The provision of a pumping apparatus which is relatively simple in its construction and which therefore may be manufactured at a low cost; one which is comprised of a minimum number of moving parts and which therefore is unlikely to get out of order; one which is rugged and durable and which therefore will withstand rough usage; one which is capable of ease of assembly and disassembly for purposes of inspection of parts or removal thereof for replacement or repair; one which is fully automatic in its operation and requires little or no attention on the part of an operator; and one which, otherwise, is well adapted to perform the services required of it are further desirable features which have been borne in mind in the production and development of the present invention.

Other objects and advantages of the invention, not at this time enumerated, will become readily apparent as the nature of the invention is better understood.

In the accompanying single sheet of drawings forming a part of this specification, one illustrative embodiment of the invention has been shown.

Figure 2:
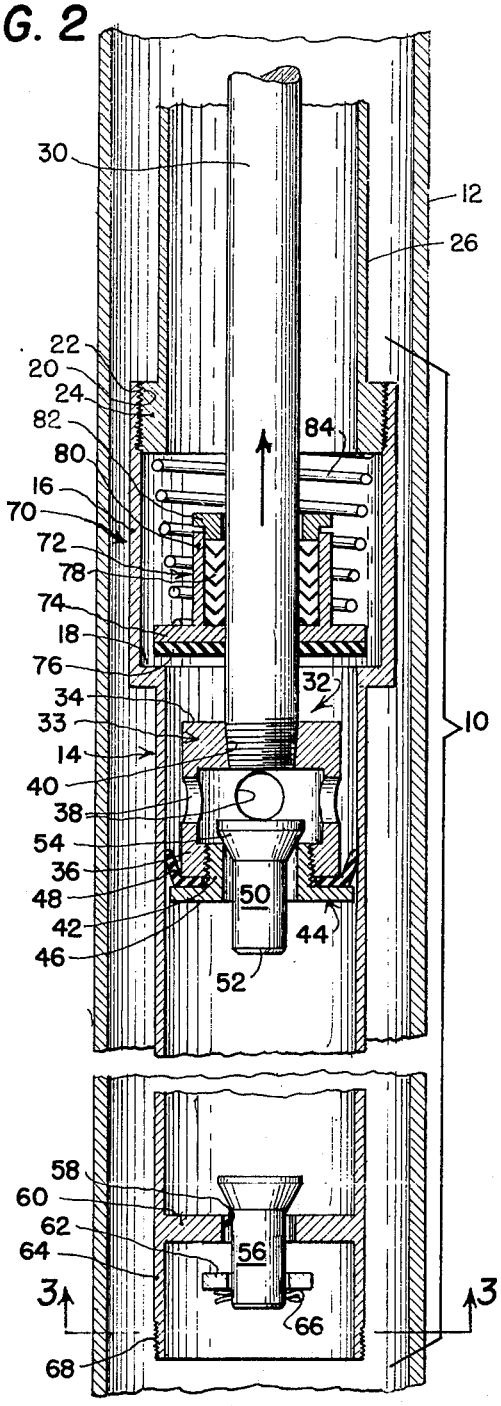
FIG. 2 is a fragmentary sectional view, similar to FIG. 1, and in which the parts are shown in the positions which they assume during the upstroke of the pump plunger.

Referring now to the drawings in detail, the pump assembly of the present invention is designated in its entirety by the reference numeral 10 and it is shown as being operatively disposed in a well casing 12 which, for purposes of discussion herein will be regarded as being associated with a water well although the principles of the invention are equally applicable to oil well pumping operations.

The pump assembly 12 involves in its general organization a vertically elongated cylinder 14, the upper end of which communicates with an enlarged diameter section which establishes a cylindrical valve housing 16. The juncture between the lower end of the valve housing 16 and the upper end of the cylinder 14 is established by the provision of an internal annular ledge which establishes a valve seat 18, the nature and function of which will be set forth presently. The upper rim region of the valve housing 16 is provided with internal threads 20 which are designed for mating engagement with external threads 22 formed on the enlarged lower end region 24 of a water outlet pipe or drop tube 26 by means of which the entire pump assembly 10 may be suspended within the well casing 12 at the proper pumping depth.

A vertically reciprocable pump shaft 30 projects downwardly through the upper end of the outlet pipe 26 and carries at its lower end a combined plunger and traveling valve assembly 32, the function of which is to repeatedly raise water or other liquid within the cylinder 14 and force the same, together with any air or other gases which may be captured within the cylinder, upwardly and into the outlet pipe 26, all in a manner and for a purpose that will be set forth in detail subsequently.

The combined plunger and traveling valve assembly includes a piston or plunger proper 33 in the form of an inverted cup-shaped body having a top wall 34 and a depending cylindrical side wall 36 which is provided with a series of circumferentially spaced ports 38 therein. A threaded opening 40 which is formed centrally in the top wall 34 receives the lower threaded end of the pump shaft 30. The lower open end of the plunger 33 threadedly receives therein the hollow tubular stem portion 42 of a seat-forming clamping nipple 44, the latter being provided with a head portion 46 by means of which a rubber or other elastomeric cup-shaped lip seal 48 is held in position on the plunger 32 for cooperation with the wall of the cylinder 14. Projecting completely through the nipple 44 is a lift valve element or member 50 which includes a valve stem 52 and a frusto-conical valve head 54, the latter being designed for cooperation with and normally resting on the upper open rim of the nipple 44 which thus establishes a valve seat for the valve member 50.

The lower end of the cylinder 14 is preferably, but not necessarily, provided with the usual foot valve arrangement which, in the illustrated form of the invention, is comprised of a valve member 56, similar to the valve element 50 which seats within an inlet fort or opening 58 provided in a circular bottom wall 60 for the cylinder 14. The stem portion of the valve element 50 is guided in a transverse strut 62 which extends across a short lower cylinder extension 64 below the bottom wall of the cylinder 14, while a cotter pin 66 serves to maintain the valve element 50 captured in position within the opening 58. The cylinder extension 64 is provided with a series of external threads 68 for attachment thereto of a ballast pipe section (not shown) or other ballast member which may be used under certain circumstances to increase the overall weight of the pump assembly for hold down purposes as will be described subsequently.

The arrangement of parts thus far described are more or less conventional since well pumping apparatus embodying a combined piston and traveling valve arrangement similar in function to the assembly 32, and also embodying a foot valve similar in function to the illustrated foot valve arrangement 56, 58, 60 are well-known. Therefore, no claim is made herein to any novelty associated with the heretofore described traveling plunger and valve assembly 32, whether these assemblies be considered singly or in combination with each other, the novelty of the present invention residing rather in the association with the traveling plunger and valve assembly 32 of a head valve assembly 70 which includes the aforementioned cylindrical valve housing 16 and which will now be described in detail and subsequently claimed.

Figure 1:
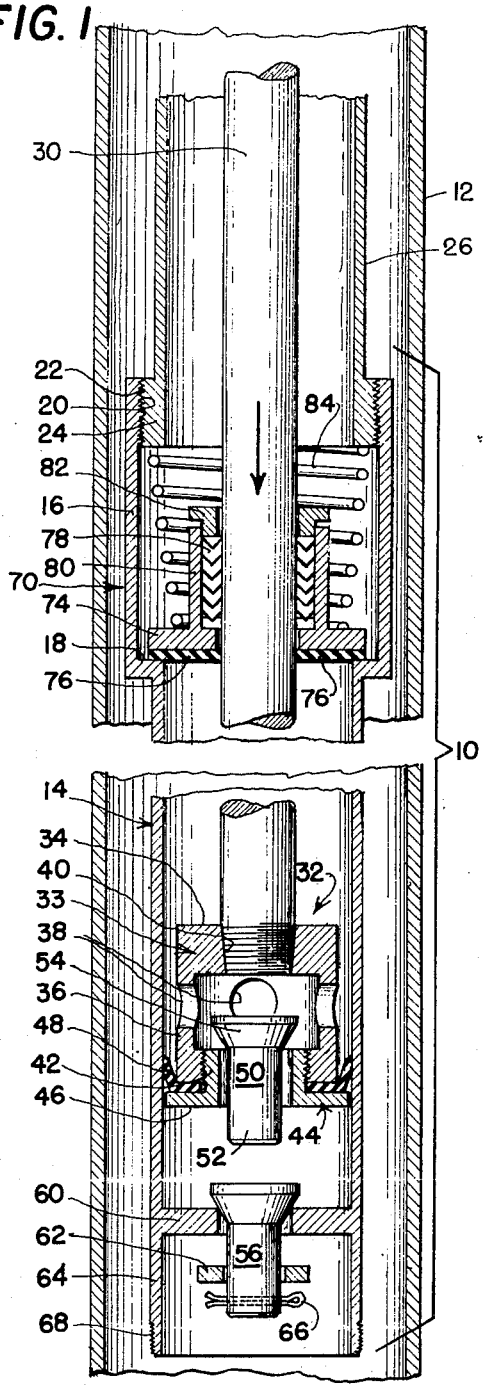
FIG. 1 is a fragmentary sectional view taken substantially centrally and longitudinally through a well casing within which the pump assembly of the present invention is operatively installed, the parts being shown in the positions which they assume during the downstroke of the pump plunger.
Figure 3:
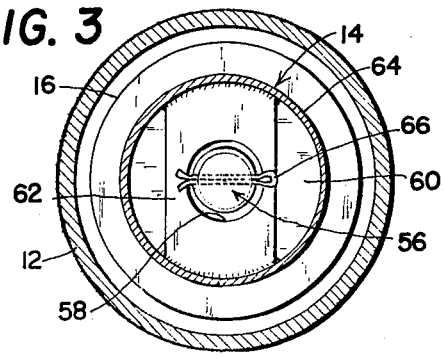
FIG. 3 is a sectional view taken substantially on the line 3—3 of FIG. 2.

As clearly shown in FIGS. 1 and 2, the head valve assembly 70 is disposed above the level of the traveling plunger and valve assembly 32 and, in addition to the valve housing 16, it is comprised of a floating valve member 72 consisting of an annular disk-like valve body 74 to the underneath face of which there is bonded or otherwise secured an elastomeric sealing ring or element proper 76 which normally rests upon the aforementioned valve seat 18. The valve body 74 and sealing ring 76 encompass the pump shaft 30, are slidably disposed thereon, and are sealingly disposed relative thereto by means of a chevron packing gland 78 which is contained within an upstanding cylindrical wall 80 integrally formed on the valve body 74 and which has associated therewith a gland nut 82. A helical compression spring 84 is interposed between the valve body 74 and the enlarged lower end 24 of the outlet pipe 26 and serves to yieldingly urge the sealing ring 76 against its seat 18.

It will be understood that in the operation of the herein described pump assembly 10, during well pumping operations the upper end of the pump shaft 30 will be operatively connected by a conventional cable socket or the like (not shown) to the cable of a well driller's rig by means of which the cable, and consequently the pump shaft 30, may be raised or lowered to the desired pumping level and then reciprocated vertically. During the downstroke of the pump shaft 30, the liquid column acting on the head valve assembly 70, coupled with the force of the spring 84, will maintain the elastomeric sealing ring 76 seated on the valve seat 18 so that as the shaft slides axially through the packing gland 76 the liquid column in the water outlet pipe 26 will be held in check and will not follow the downward movement of the plunger 33. Such downward movement of the plunger 33 will thus create a partial vacuum within the cylinder 14 above the plunger so that the valve element 50 of the combined plunger and traveling valve assembly 32 will be lifted from its seat as shown in FIG. 1 to admit liquid through the nipple 44 to the interior of the plunger 33 and from thence radially outwardly through the ports 38 to the space surrounding and above the plunger and within the cylinder 14. At the same time, the foot valve member 56 will remain seated so that the liquid in the lower region of the cylinder 14 below the plunger 33 will be positively forced through the traveling valve assembly 32. In the absence of any appreciable amount of air or other gaseous fluid in the liquid undergoing pumping, at such time as the plunger reaches its lowermost position within the cylinder 14 the portion of the cylinder 14 above the plunger 33 will thus become substantially filled with liquid.

During the subsequent upstroke of the pump shaft 30, all of this liquid which is disposed above the piston will be carried bodily upwardly within the cylinder 14 due to the fact that the lift valve member 50 of the traveleing valve assembly 32 will become seated on the nipple 44 as shown in FIG. 2. This solid column of liquid will then cause the floating valve element 72 to be lifted from its seat 18 against the yielding action of the spring 84, thus consolidating this column of liquid with the column of liquid above the valve seat and within the outlet pipe 26 and moving such combined column of liquid upwardly so as to effect an outflow of liquid at ground level. At the same time, as the liquid column is thus shifted upwardly by reason of the upward movement of the plunger 33, the foot valve element 56 will be lifted from its seat as shown in FIG. 2 so that additional liquid within the casing 30 will be drawn into the cylinder 14. The operation is, of course, repetitious during reciprocation of the pump shaft 30.

It is to be noted at this point that where little or no air or other gaseous media are encountered within the casing 30, the function of the head valve assembly 70 is of secondary importance, the valve element proper or sealing ring 76 merely becoming seated at such time as the plunger 33 commences its downward movement and becoming unseated at such time as it commences its upward movement. In the absence of such head valve assembly 70 with a full solid head or column of liquid closure of the foot valve element 56 would ordinarily prevent the liquid column in the liquid outlet pipe 26 from following the downward movement of the plunger 33. The importance of the novel head valve assembly 70 of the present invention becomes evident when an excessive amount of air or other gas enters the cylinder 14 through the foot valve as the plunger 33 moves upwardly. Under such circumstances, where an excessive amount of gas is disposed within the cylinder below the traveling valve assembly 32 and above the foot valve element 56, downward movement of the plunger 33 will cause such gas to be compressed and, in the absence of the present head valve assembly 70, the liquid column above the plunger will follow the latter downwardly and thus hold the valve element 50 of the traveling valve seated so that such gas cnnot escape upwardly into the outlet pipe 26. During the return or upward stroke of the plunger 33, the gas below the plunger will expand but because of the excessive amount of gas the foot valve element 56 will remain seated so that no fresh gas or liquid may enter the cylinder. Under such circumstances reciprocation of the pump shaft will merely effect a bouncing action on the plunger 33 and no pumping action will take place, the gas within the cylinder merely becoming alternately compressed and expanded.

However, by reason of the presence of the novel head valve of the present invention at a region above the level of the combined plunger and traveling valve assembly 32, the liquid column within the outlet pipe 26 is prevented from following the plunger 33 downwardly as previously described so that as the plunger 33 moves downwardly and away from the then seated head valve element 76, the partial vacuum which is created above the plunger and within the cylinder 14 causes the traveling valve element 50 to be lifted from its seat so that the plunger and valve assembly 32 then functions as a gas pump to carry the excess gas upwardly and into the outlet pipe 26. With the pressure of gas within the cylinder above the foot valve element 56 thus relieved, the latter may be raised from its seat to admit fresh gas or liquid to the cylinder for pumping purposes. Moreover, such a process is conducive to the creation of a vacuum below the pump, this being a phenomena which has long been recognized as being important in well development.

The invention is not to be limited to the exact arrangement of parts shown in the accompanying drawings or described in this specification as various changes in the details of construction may be resorted to without departing from the spirit of the invention. For example, although the present water well pump assembly 10 is disclosed herein in a well environment wherein it is maintained at the desired level within the well casing 12 by means of an outlet pipe or drop tube such as the pipe 26, the use of such a drop tube is not essential, providing of course that suitable means be provided for sealing the pump assembly to the wall casing so that the open upper end of the cylinder 14 communicates directly with the upper region of the well casing, in which case the head valve will discharge liquid or gas directly into the liquid column within such casing above the cylinder. Furthermore, although no connection has been disclosed herein by means of which the pump assembly may be locked in position at the desired pumping level within the well casing in the absence of a drop tube such as the tube 26 various locking devices are capable of being employed for this purpose, one such device being shown and described in my prior U.S. Pat. No. 2,638,851, granted on May 19, 1953 and entitled "Well Driller Cleanout Pump Assembly." Finally, it should be understood that various forms of foot valve assemblies and traveling plunger valve assemblies may be substituted for the specific forms of valve assemblies shown and described herein, the only criterion being that they perform substantially the same function as those performed by the valve elements 56 and 50. Therefore, only insofar as the invention has particularly been pointed out in the accompanying claims is the same to be limited.

Having thus described my invention, what I claim and desire to secure by Letters Patent is:

1. A pump assembly adapted to be supported at a selected pumping level within a tubular well casing and effective to repeatedly withdraw quantities of liquid and gas from said casing and discharge the same at ground level, said pump assembly comprising an elongated vertically disposed cylinder having a circular bottom wall provided with a central inlet port for the admission of gas and liquid upwardly into the cylinder, a unidirectional foot valve normally seated upon said port and closing the same, said foot valve being responsive to differential fluid pressure on opposite sides of said bottom wall and being effective to admit gas and liquid upwardly through said port when fluid pressure beneath said bottom wall exceeds the fluid pressure within the cylinder, a pump shaft reciprocal vertically within said cylinder and coaxial therewith, a combined plunger and traveling valve assembly within said cylinder and including an inverted cup-shaped plunger having a top wall fixedly secured to the lower end of said pump shaft and a depending cylindrical side wall provided with circumferentially spaced ports therethrough, a tubular clamping nipple threadedly received within the lower rim region of said side wall, an elastomeric sealing ring interposed between said nipple and the lower rim of said plunger and establishing a lip seal with the cylinder, and a lift valve normally closing the upper end of said tubular nipple, said lift valve being responsive to pressure of fluid beneath said plunger during the downstroke of the latter to bypass such fluid upwardly through said nipple and plunger, and being responsive to pressure of fluid above said plunger to prevent such upward passage of fluid, the upper end of said cylinder being formed with an enlarged diameter extension which establishes a valve housing, the juncture region between said cylinder and extension providing an annular ledge which establishes a valve seat, a floating head valve member disposed within said valve housing and encompassing said pump shaft, said head valve member including an annular disk-like valve body and an upstanding cylindrical wall concentric with the pump shaft, a packing gland disposed within said cylindrical wall and effective between the pump shaft and wall, a gland nut threadedly received in the upper end of said cylindrical wall, an elastomeric sealing ring mounted on the underneath side of said disk-like valve body and normally seated on said valve seat, a cylindrical drop tube encompassing said pump shaft and having its lower end threadedly received in the upper end of said cylindrical wall, and a compression spring interposed between the lower end of said drop tube and disklike valve body exteriorly of the cylindrical wall and serving to yieldingly bias said valve member against said valve seat.

2. A pump assembly as set forth in claim 1, wherein said foot valve is provided with a depending stem which passes through its associated port, a strut extends diametrically across a short lower cylindrical extension of the cylinder below said circular bottom wall, and the stem is slidingly guided in an opening which is formed in said strut.

* * * * *